US011053727B2

(12) United States Patent
Houk

(10) Patent No.: US 11,053,727 B2
(45) Date of Patent: Jul. 6, 2021

(54) AUTOMATED WINDOW SHUTTER ASSEMBLY

(71) Applicant: Shawn Houk, Oklahoma City, OK (US)

(72) Inventor: Shawn Houk, Oklahoma City, OK (US)

( * ) Notice: Subject to any disclaimer, the term of this patent is extended or adjusted under 35 U.S.C. 154(b) by 76 days.

(21) Appl. No.: 16/437,177

(22) Filed: Jun. 11, 2019

(65) Prior Publication Data

US 2020/0392778 A1 Dec. 17, 2020

(51) Int. Cl.

| | |
|---|---|
| ***E05F 11/34*** | (2006.01) |
| ***E05F 15/652*** | (2015.01) |
| ***E06B 9/04*** | (2006.01) |
| *E06B 7/082* | (2006.01) |

(52) U.S. Cl.

CPC ..... *E05F 15/652* (2015.01); *E06B 9/04* (2013.01); *E05Y 2900/146* (2013.01); *E06B 7/082* (2013.01)

(58) Field of Classification Search

CPC ..... E05F 15/652; E06B 9/04; E06B 7/082; E05Y 2900/146

USPC ..... 49/361, 362

See application file for complete search history.

(56) References Cited

U.S. PATENT DOCUMENTS

| | | | | |
|---|---|---|---|---|
| 2,091,706 A | | 8/1937 | Flint | |
| 2,513,042 A | | 6/1950 | Muhn | |
| 2,936,498 A | | 5/1960 | Scott | |
| 3,020,951 A | | 2/1962 | Graulich | |
| 3,452,477 A | * | 7/1969 | Sassano | E06B 3/4609 49/116 |
| 3,494,073 A | * | 2/1970 | Meddick | E06B 7/08 49/123 |
| 3,745,705 A | * | 7/1973 | Reddy | E05F 15/657 49/139 |
| 4,091,570 A | * | 5/1978 | Favrel | E05F 15/652 49/118 |
| 4,457,106 A | * | 7/1984 | Forquer | E06B 9/04 160/197 |
| 4,698,938 A | * | 10/1987 | Huber | F16H 25/2018 49/138 |
| 5,341,598 A | * | 8/1994 | Reddy | B61D 19/02 49/362 |
| 5,826,377 A | * | 10/1998 | Simson | E05D 15/0656 49/362 |
| 5,893,242 A | * | 4/1999 | Perron | E05F 11/36 52/202 |

(Continued)

*Primary Examiner* — Jerry E Redman

(57) ABSTRACT

An automated window shutter assembly includes a pair of shutters that is each movably positioned on an exterior wall of a building. Each of the shutters is positionable in an open position or a closed position. A housing is coupled to the exterior wall of the building and the housing is positioned above the window. A pair of screws is each rotatably positioned within the housing and each of the screws is rotatable in a closing direction or an opening direction. A drive unit is positioned within the housing and the drive unit engages each of the screws. The drive unit is turned on to rotate each of the screws in the closing direction or the opening direction. A plurality of engagements each threadably engages a respective one of the screws. Each of the engagements is coupled to a respective one of the shutters for opening and closing the shutters.

12 Claims, 8 Drawing Sheets

(56) References Cited

U.S. PATENT DOCUMENTS

| | | | | |
|---|---|---|---|---|
| 6,021,608 | A * | 2/2000 | Ollison | E05B 65/08 292/67 |
| 6,345,476 | B1 | 12/2002 | Hill | |
| 6,658,793 | B2 * | 12/2003 | Perron | E05F 11/04 49/123 |
| 6,745,522 | B2 | 6/2004 | Germain | |
| 7,730,929 | B2 * | 6/2010 | Perron | E06B 9/02 160/202 |
| 7,814,705 | B2 | 10/2010 | Reed | |
| D667,136 | S | 9/2012 | Johnston | |
| 8,661,733 | B2 * | 3/2014 | Lee | E05B 47/0012 49/118 |
| 9,074,401 | B2 * | 7/2015 | Jensen | E06B 7/02 |
| 2004/0244295 | A1 * | 12/2004 | Derham | E05F 15/41 49/362 |
| 2009/0090062 | A1 | 4/2009 | Pandorf | |
| 2012/0011778 | A1 * | 1/2012 | Kong | E05B 81/70 49/503 |
| 2012/0073208 | A1 * | 3/2012 | Lee | E05F 15/652 49/449 |
| 2013/0298706 | A1 * | 11/2013 | Linnenkohl | B60J 5/06 74/89 |

* cited by examiner

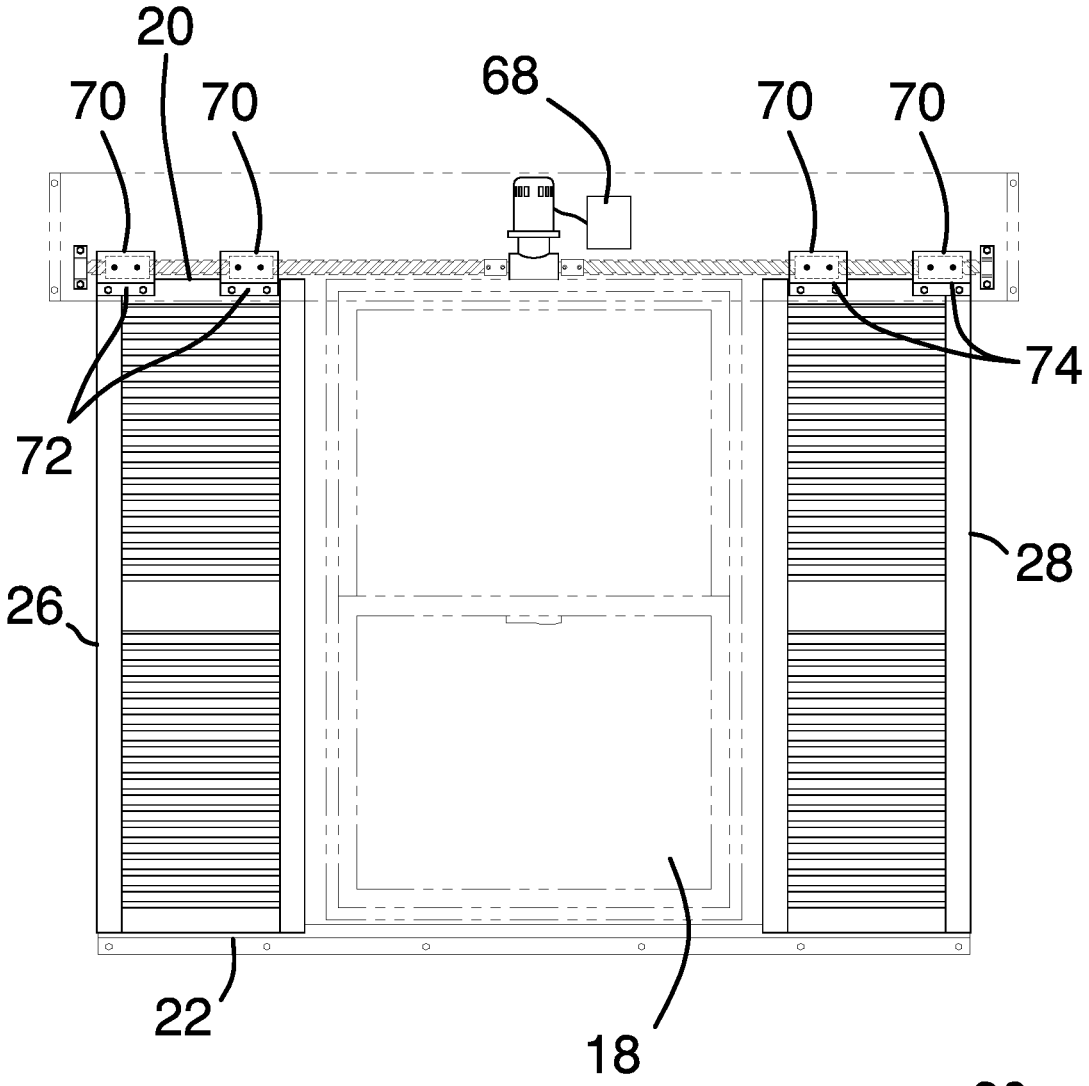
FIG. 3
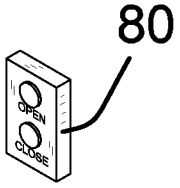

AUTOMATED WINDOW SHUTTER ASSEMBLY

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shutter devices and more particularly pertains to a new shutter device for remotely opening and closing window shutters.

BRIEF SUMMARY OF THE INVENTION

An embodiment of the disclosure meets the needs presented above by generally comprising a pair of shutters that is each movably positioned on an exterior wall of a building. Each of the shutters is positionable in an open position or a closed position. A housing is coupled to the exterior wall of the building and the housing is positioned above the window. A pair of screws is each rotatably positioned within the housing and each of the screws is rotatable in a closing direction or an opening direction. A drive unit is positioned within the housing and the drive unit engages each of the screws. The drive unit is turned on to rotate each of the screws in the closing direction or the opening direction. A plurality of engagements each threadably engages a respective one of the screws. Each of the engagements is coupled to a respective one of the shutters for opening and closing the shutters.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 3 is a front phantom view of an embodiment of the disclosure.

DETAILED DESCRIPTION OF THE INVENTION

Figure 1:
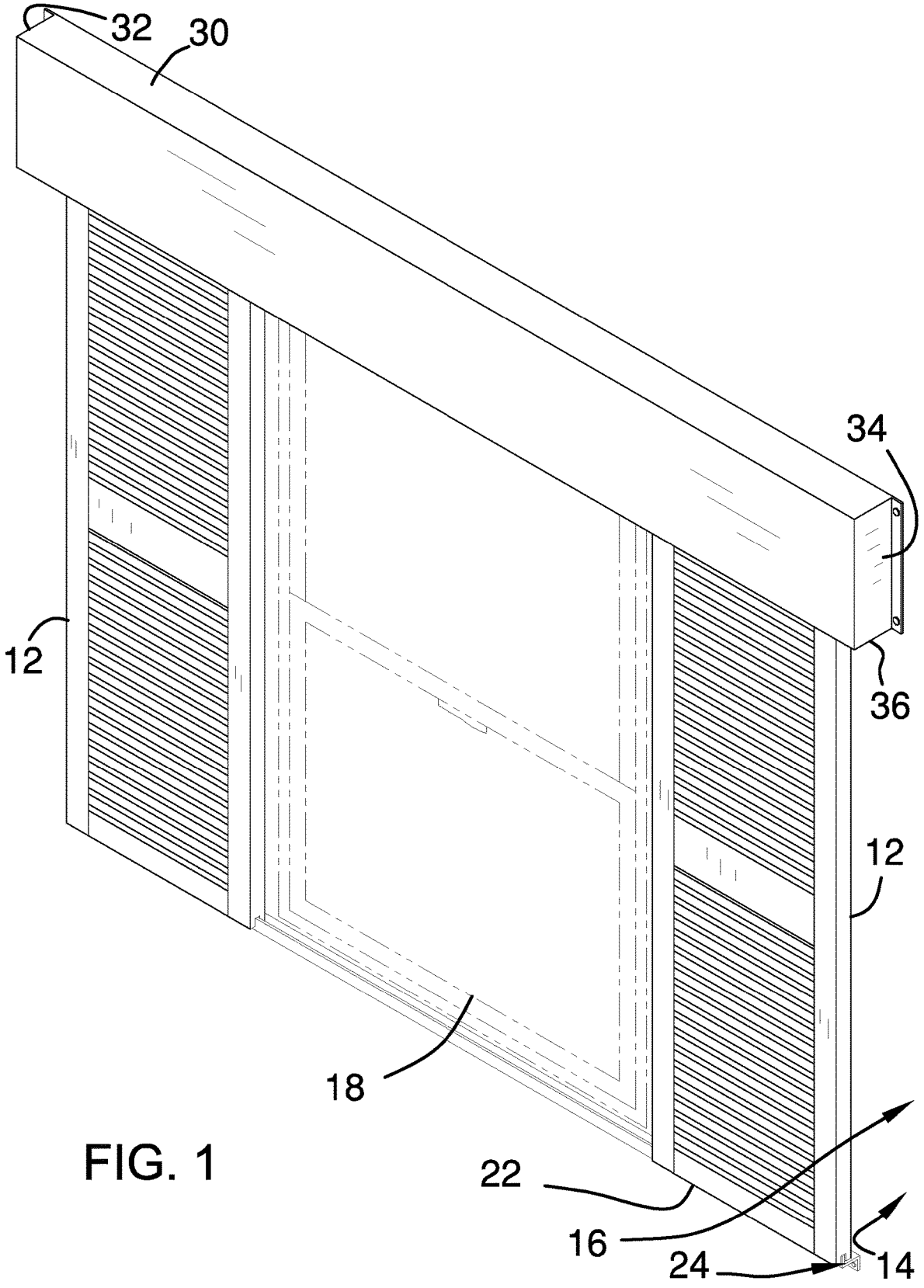
FIG. 1 is a perspective view of a automated window shutter assembly according to an embodiment of the disclosure.
Figure 2:
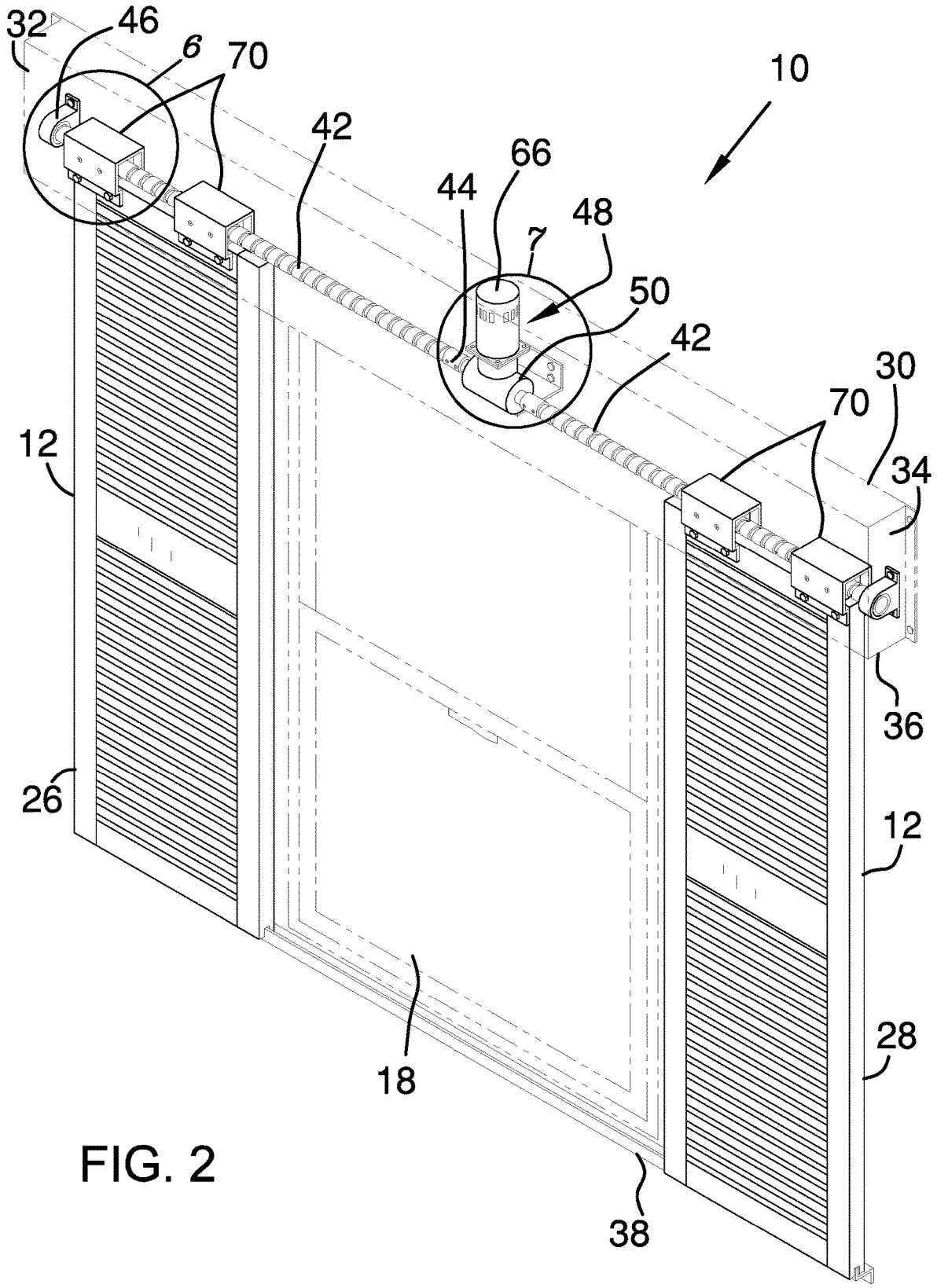
FIG. 2 is a perspective phantom view of an embodiment of the disclosure.
Figure 4:
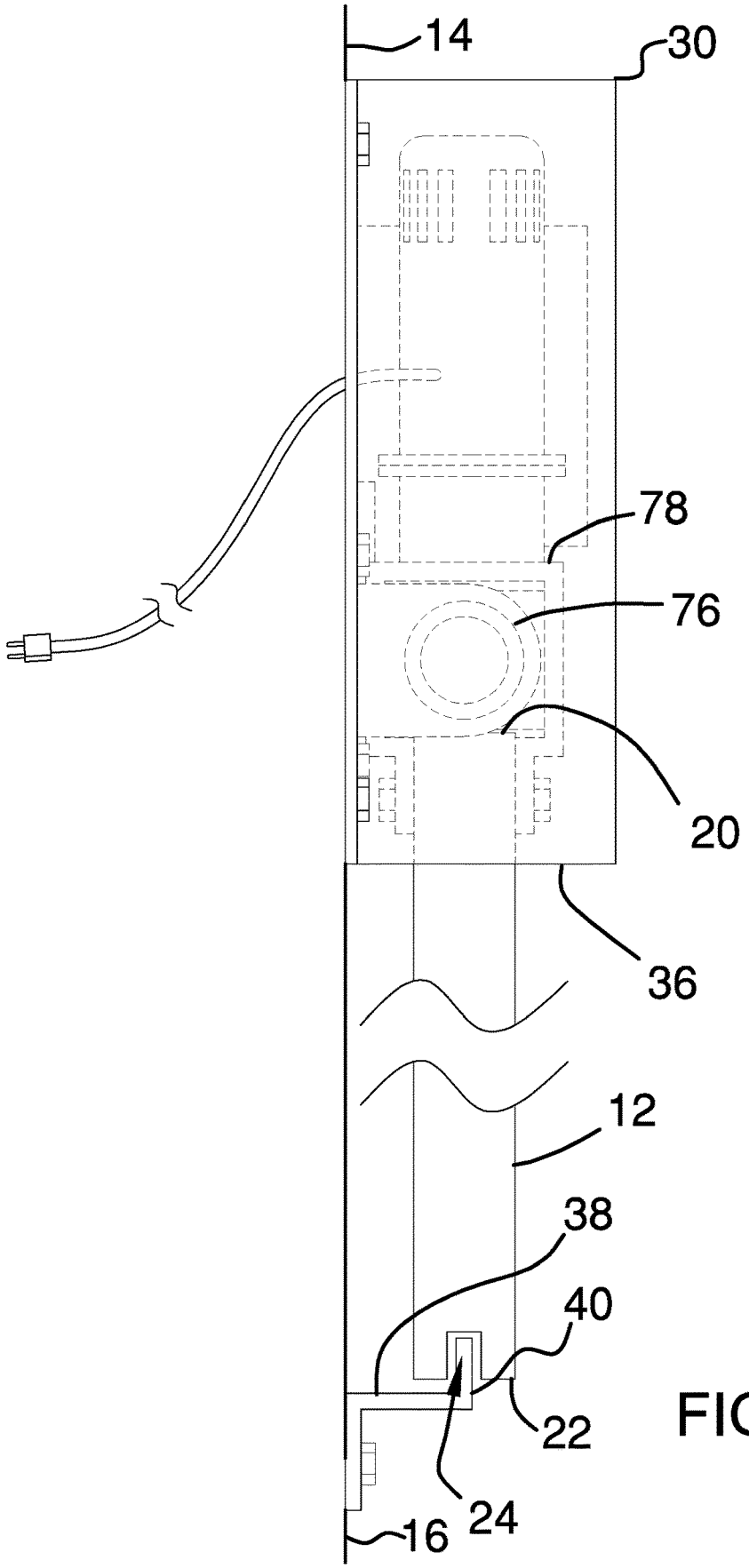
FIG. 4 is a right side phantom view of an embodiment of the disclosure.
Figure 5:
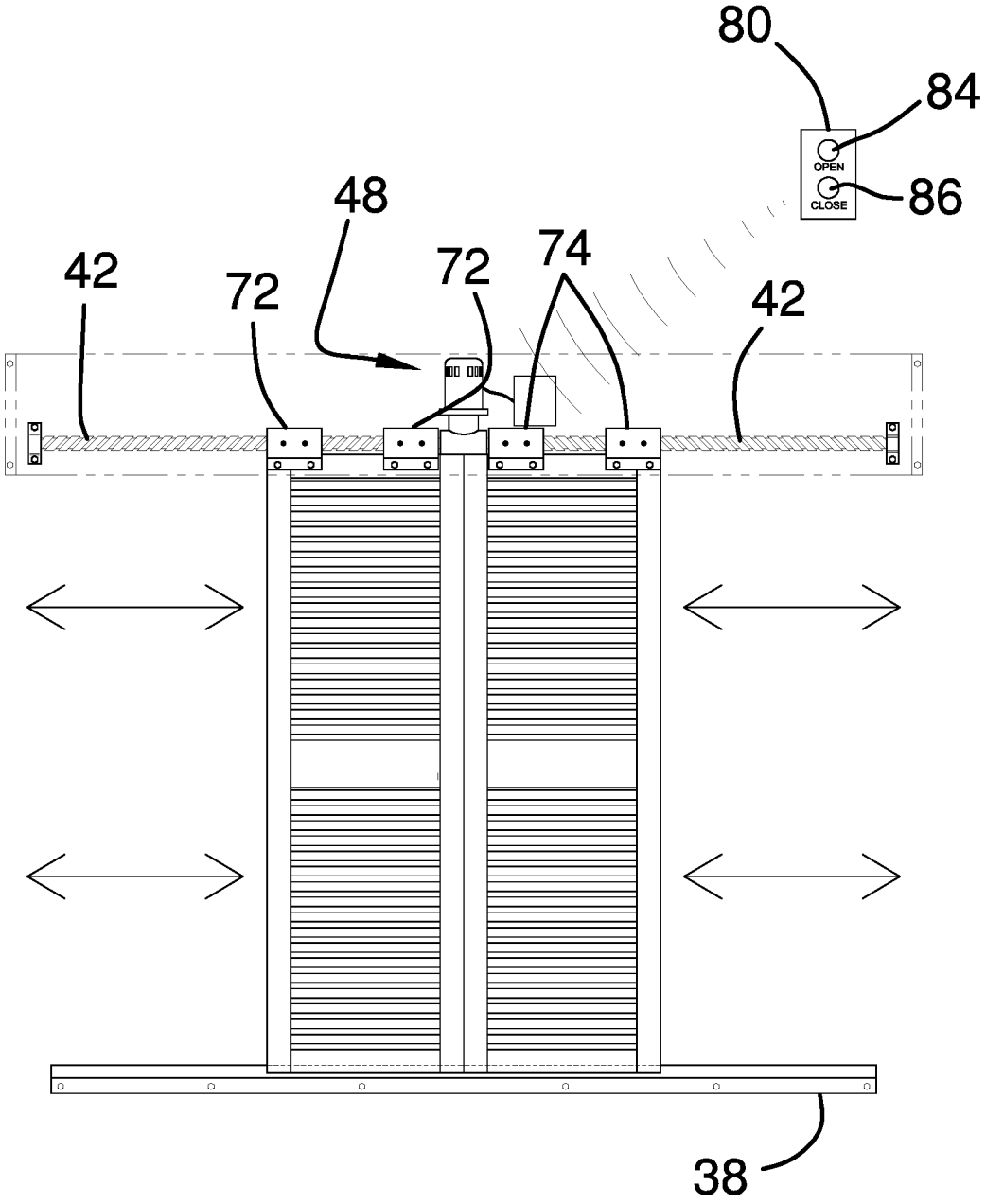
FIG. 5 is a front phantom view of an embodiment of the disclosure showing a pair of shutters in a closed position.
Figure 6:
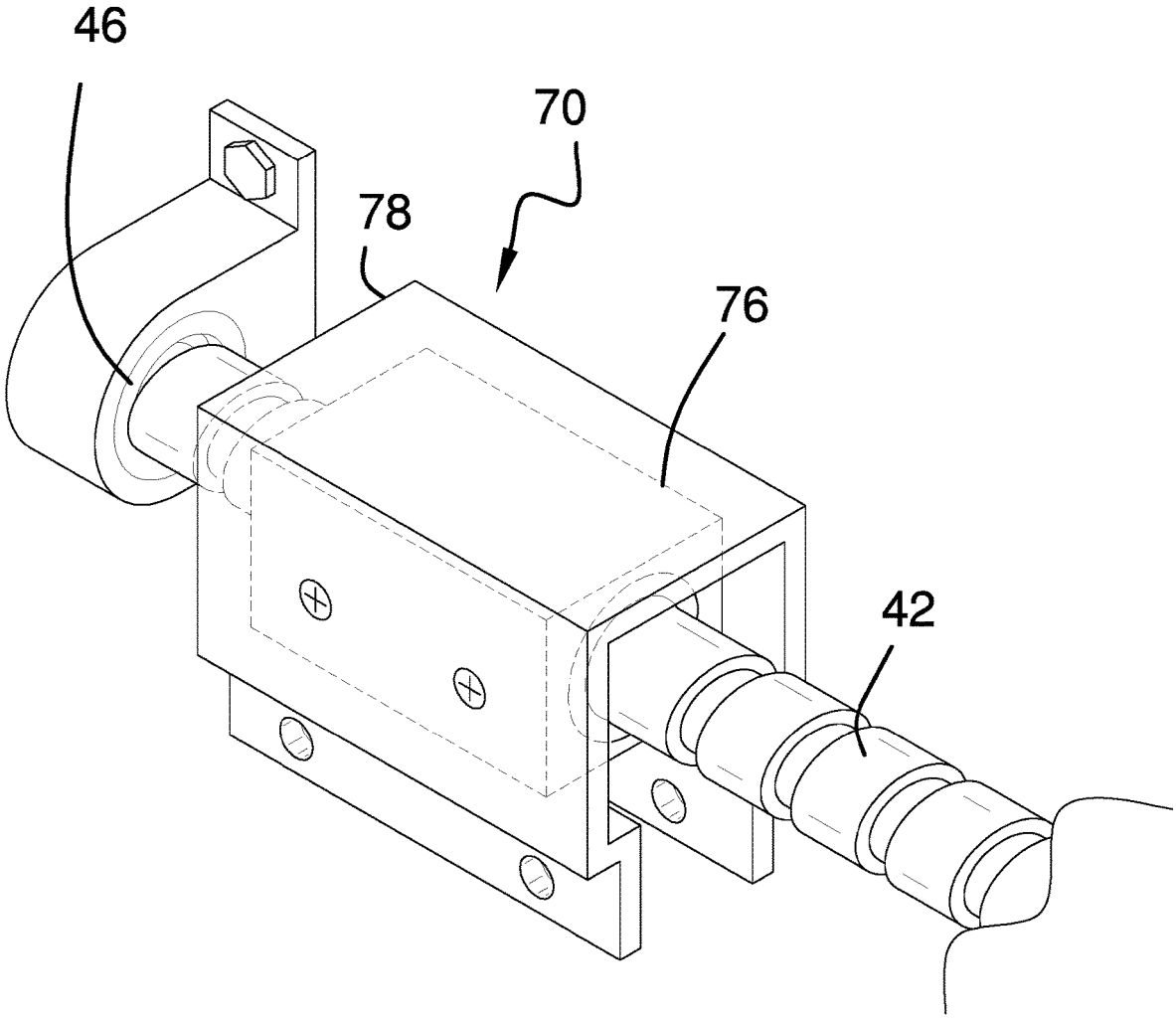
FIG. 6 is a detail view taken from circle 6 of FIG. 2 of an embodiment of the disclosure.
Figure 7:
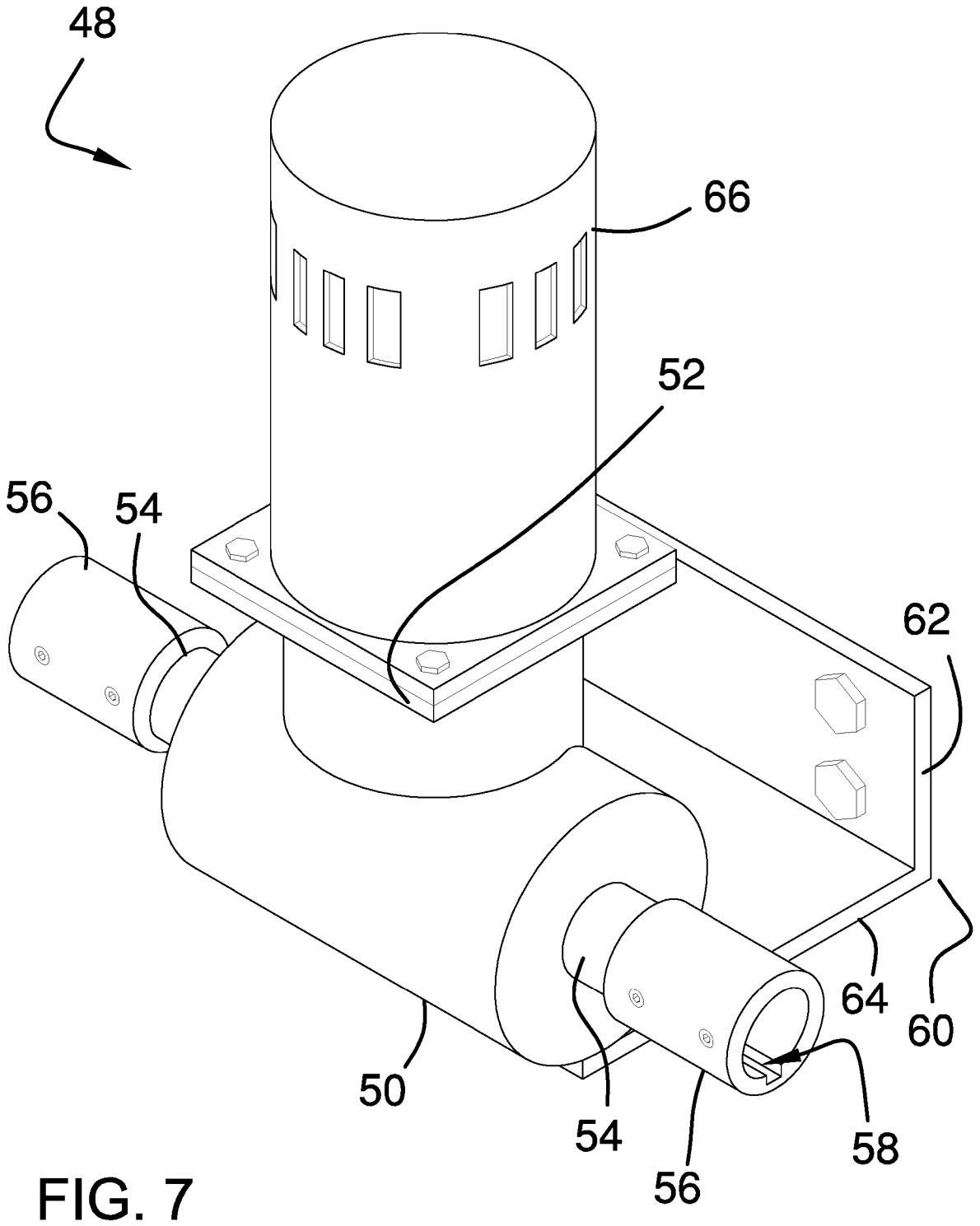
FIG. 7 is a detail view taken from circle 7 of FIG. 2 of an embodiment of the disclosure.
Figure 8:
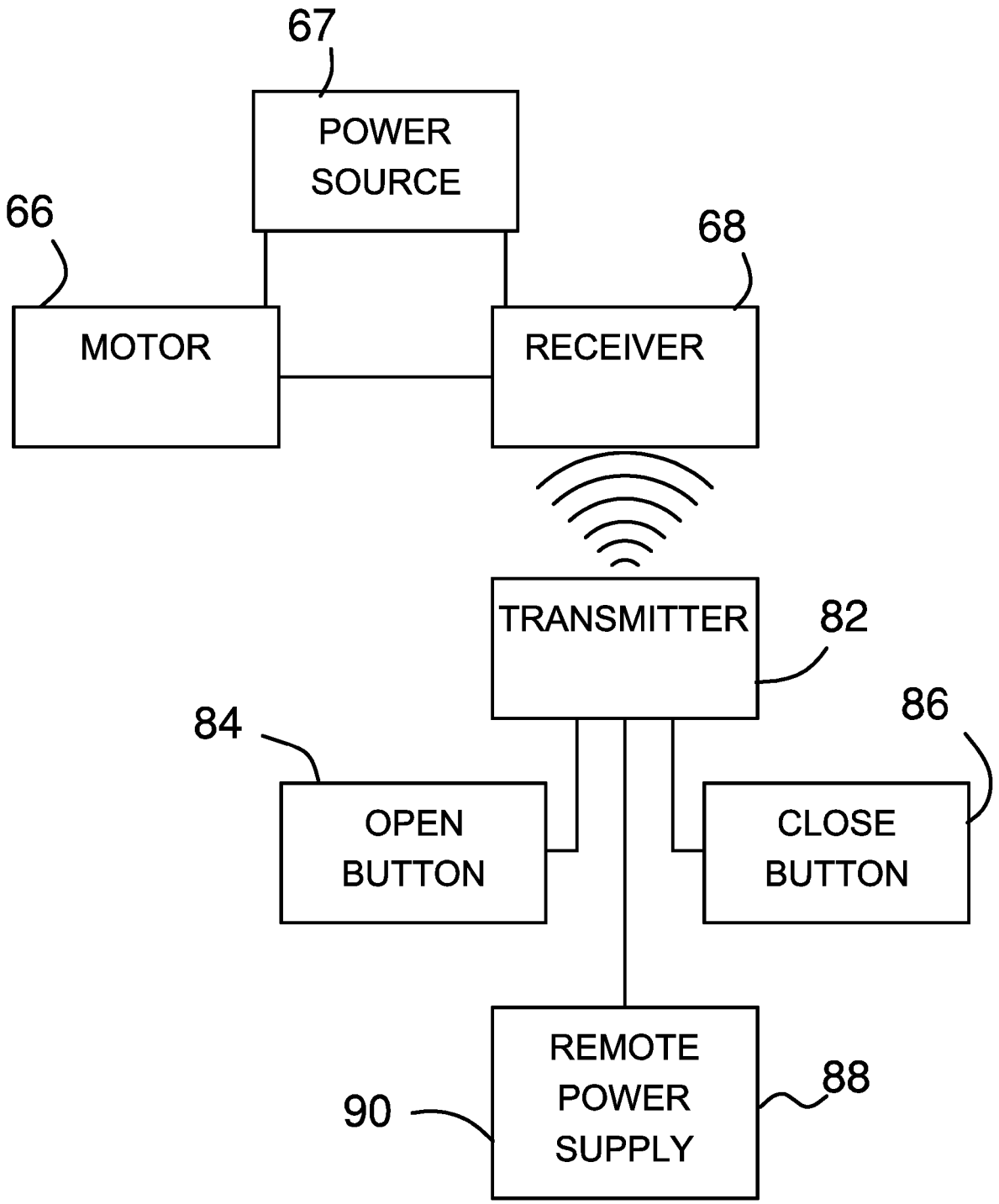
FIG. 8 is a schematic view of an embodiment of the disclosure.

With reference now to the drawings, and in particular to FIGS. 1 through 8 thereof, a new shutter device embodying the principles and concepts of an embodiment of the disclosure and generally designated by the reference numeral 10 will be described.

As best illustrated in FIGS. 1 through 8, the automated window shutter assembly 10 generally comprises a pair of shutters 12 that are each movably positioned on an exterior wall 14 of a building 16, such as a house or the like. Each of the shutters 12 is positionable in an open position having each of the shutters 12 being positioned on opposite sides of a window 18 in the exterior wall 14 of the building 16. Each of the shutters 12 is positionable in a closed position having each of the shutters 12 covering the window 18. Each of the shutters 12 has a top edge 20 and a bottom edge 22, and the bottom edge 22 of each of the shutters 12 has a groove 24 extending toward the top edge 20. The groove 24 on each of the shutters 12 is coextensive with the bottom edge 22 of the respective shutter 12. The pair of shutters 12 includes a first shutter 26 and a second shutter 28. Moreover, each of the shutters 12 may be window shutters of any conventional design or appearance.

A housing 30 is coupled to the exterior wall 14 of the building 16 and the housing 30 is positioned above the window 18. The housing 30 has a first end 32, a second end 34 and a lower side 36 extending therebetween. The lower side 36 is open into an interior of the housing 30, and the housing 30 is elongated between the first end 32 and the second end 34. The housing 30 is horizontally oriented having the lower side 36 being positioned above the window 18. Additionally, each of the shutters 12 extends into the lower side 36 of the housing 30 having the top edge 20 of each of the shutters 12 being positioned in the housing 30.

A track 38 is provided and the track 38 is coupled to the exterior wall 14 of the building 16. The track 38 is positioned beneath each of the shutters 12, the track 38 is horizontally oriented and the track 38 has a length that is at least equal to the length of the housing 30. The track 38 includes a vertical portion 40 that is spaced outwardly from the exterior wall 14 of the housing 30. The vertical portion 40 engages the groove 24 in the bottom edge 22 of each of the shutters 12. In this way the bottom edge 22 of each of the shutters 12 is inhibited from moving away from the exterior wall 14 of the building 16 when the shutters 12 are moved between the open position and the closed position.

A pair of screws 42 is each rotatably positioned within the housing 30. Each of the screws 42 extends from a respective one of the first end 32 and the second end 34 of the housing 30 toward a center of the housing 30. Each of the screws 42 has a primary end 44 and a secondary end 46. The primary end 44 of each of the screws 42 is directed toward the center of the housing 30. Additionally, each of the screws 42 is rotatable in a closing direction or an opening direction.

A drive unit 48 is provided and the drive unit 48 is positioned within the housing 30. The drive unit 48 engages each of the screws 42. The drive unit 48 is turned on to rotate each of the screws 42 in a first direction or a second direction. The drive unit 48 comprises a gear box 50 that has an input 52 and a pair of outputs 54. The gear box 50 is positioned within the housing 30 and the primary end 44 of each of the screws 42 is coupled to a respective one of the outputs 54. The input 52 is in mechanical communication with each of the outputs 54 such that the input 52 rotates each of the outputs 54 when the input 52 is rotated. Moreover, the input 52 has a rotational axis that is oriented perpendicular to a rotational axis of each of the outputs 54.

Each of the outputs 54 may include a socket 56 that insertably receives the primary end 44 of the respective screw. The socket 56 may have a keyway 58 for receiving a key on the respective screw. Additionally, the drive unit 48 may include a bracket 60 that has a first portion 62 being oriented perpendicular to a second portion 64. The first portion 62 may be coupled to the housing 30 such that the second portion 64 lies on a horizontal plane. The gear box 50 may be coupled to the second portion 64 of the bracket 60.

The drive unit 48 includes a motor 66 that is coupled to the gear box 50. The motor 66 engages the input 52 and the motor 66 can be turned on to rotate in a first direction or a second direction. The motor 66 rotates the input 52 in the first direction when the motor 66 is turned on to rotate in the first direction. In this way each of the screws 42 is rotated in the opening direction. The motor 66 rotates the input 52 in the second direction when the motor 66 is turned on to rotate in the second direction. In this way each of the screws 42 is rotated in the closing direction. The motor 66 is electrically coupled to a power source 67 comprising an electrical system of the building 16. Additionally, the motor 66 may comprise an electric motor or the like and the motor 66 may be coupled to the first portion 62 of the bracket 60.

The drive unit 48 includes a receiver 68 that is positioned in the housing 30. The receiver 68 is electrically coupled to the motor 66. Additionally, the receiver 68 is electrically coupled to the power source 67 comprising the electrical system of the building 16. The receiver 68 may comprise a radio frequency receiver or the like.

A plurality of engagements 70 is included and each of the engagements 70 threadably engages a respective one of the screws 42. Each of the engagements 70 travels toward the center of the housing 30 when the screws 42 are rotated in the closing direction. Additionally, each of the engagements 70 travels toward a respective one of the first end 32 and the second end 34 of the housing 30 when the screws 42 are rotated in the opening direction. The plurality of engagements 70 includes a set of first engagements 72 and a set of second engagements 74. Each of the first engagements 72 has a respective one of the screws 42 extending therethrough. Each of the second engagements 74 has a respective one of the screws 42 extending therethrough.

Each of the first engagements 72 is coupled to the top edge 20 of the first shutter 26. Each of the second engagements 74 is coupled to the top edge 20 of the second shutter 28. Each of the first shutter 26 and the second shutter 28 is urged into the open position when the screws 42 are rotated in the opening direction. Additionally, each of the first shutter 26 and the second shutter 28 is urged into the closed position when the screws 42 are rotated in the closing direction. Each of the engagements 70 may include a tube 76 that threadably engages the respective screw 42. Additionally, each of the engagements 70 may include a bracket 78 that surrounds, and is coupled to, the tube. The bracket 78 may have a generally inverted U-shape, the bracket 78 may receive the top edge 20 of the respective shutter 12 and the bracket 78 may be coupled to the respective shutter 12.

A remote control 80 is provided and the remote control 80 is in wireless communication with the motor 66. The remote control 80 turns the motor 66 on in either of the first direction or the second direction for opening or closing the shutters 12. The remote control 80 comprises a transmitter 82 that is positioned within the remote control 80. The transmitter 82 is in wireless communication with the receiver 68 and the transmitter 82 broadcasts an open command or a close command to the receiver 68. Additionally, the transmitter 82 may comprise a radio frequency transmitter 82 or the like.

An open button 84 is movably coupled to the remote control 80 and the open button 84 is electrically coupled to the transmitter 82. The transmitter 82 broadcasts the open command when the open button 84 is depressed for urging each of the shutters 12 into the open position. A close button 86 is movably coupled to the remote control 80 and the close button 86 is electrically coupled to the transmitter 82. The transmitter 82 broadcasts the close command when the close button 86 is depressed for urging each of the shutters 12 into the closed position. A remote power supply 88 is positioned in the remote control 80, the remote power supply 88 is electrically coupled to the transmitter 82 and the remote power supply 88 comprises at least one battery 90. Each window 18 in the building 16 may include the shutters 12, the housing 30 and the drive unit 48. Moreover, the drive unit 48 that is associated with each window 18 may be in wireless communication with the remote control 80. In this way the shutters 12 on each window 18 in the building 16 can be remotely opened and closed.

In use, the remote control 80 is carried by an occupant of the building 16. The open button 84 on the remote control 80 is depressed to open the shutters 12. Thus, the motor 66 is turned on to rotate in the first direction thereby urging each of the shutters 12 into the open position. The close button 86 on the remote control 80 is depressed to close the shutters 12. Thus, the motor 66 is turned on the rotate in the second direction thereby urging each of the shutters 12 into the closed position. In this way the shutters 12 can be opened and closed without requiring the user to manually manipulate the shutters 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automated window shutter assembly comprising:

a pair of shutters, each of said shutters being movably positioned on an exterior wall of a building, each of said shutters being positionable in an open position having each of said shutters being positioned on opposite sides of a window on the exterior wall of the building, each of said shutters being positionable in a closed position having each of said shutters covering the window, each of said shutters having a top edge, said pair of shutters including a first shutter and a second shutter;

a housing being coupled to the exterior wall of the building, said housing being positioned above the window, said housing having a first end, a second end and a lower side extending therebetween, said lower side being open into an interior of said housing, said housing being elongated between said first end and said second end, said housing being horizontally oriented having said lower side being positioned above the window, each of said shutters extending into said lower side of said housing having said top edge of each of said shutters being positioned in said housing while in both the open position and the closed position;

a pair of screws, each of said screws being rotatably positioned within said housing, each of said screws being rotatable in a closing direction or an opening direction;

a drive unit being positioned within said housing, said drive unit including a motor, said drive unit engaging each of said screws, said drive unit being turned on to rotate each of said screws in the closing direction or the opening direction;

a plurality of engagements, each of said engagements comprising a tube directly threadably engaging a respective one of said screws whereby movement of said respective one of said screws moves said engagement, each of the engagements is coupled to a respective one of the shutters, each of said engagements urging said respective shutter between the open position or the closed position when said screws are rotated in said opening direction or said closing direction; and a remote control being in wireless communication with said motor, said remote control turning said motor on in either of said first direction or said second direction for opening or closing said shutters.

2. The assembly according to claim 1, wherein each of said screws extends from a respective one of said first end and said second end toward a center of said housing, each of said screws having a primary end and a secondary end, said primary end of each of said screws being directed toward the center of said housing.

3. The assembly according to claim 2, wherein said drive unit comprises a gear box having a input and a pair of outputs, said gear box being positioned within said housing, said primary end of each of said screws being coupled to a respective one of said outputs, said input being in mechanical communication with each of said outputs such that said input rotates each of said outputs when said input is rotated, said input having a rotational axis being oriented perpendicular to a rotational axis of each of said outputs.

4. The assembly according to claim 3, further wherein said drive unit comprises said motor being coupled to said gear box, said motor being turned on to rotate in a first direction or a second direction, said motor rotating said input in said first direction when said motor is turned on to rotate in said first direction thereby rotating each of said screws in said opening direction, said motor rotating said input in said second direction when said motor is turned on to rotate in said second direction thereby rotating each of said screws in said closing direction, said motor being electrically coupled to a power source comprising an electrical system of the building.

5. The assembly according to claim 4, wherein said drive unit comprises a receiver being positioned in said housing, said receiver being electrically coupled to said motor, said receiver being electrically coupled to the power source comprising the electrical system of the building.

6. The assembly according to claim 5, wherein said remote control comprises a transmitter being positioned within said remote control, said transmitter being in wireless communication with said receiver, said transmitter broadcasting an open command or a close command to said receiver.

7. The assembly according to claim 6, wherein said remote control comprises an open button being movably coupled to said remote control, said open button being electrically coupled to said transmitter, said transmitter broadcasting said open command when said open button is depressed for urging each of said shutters into said open position.

8. The assembly according to claim 7, wherein said remote control comprises a close button being movably coupled to said remote control, said close button being electrically coupled to said transmitter, said transmitter broadcasting said close command when said close button is depressed for urging each of said shutters into said closed position.

9. The assembly according to claim 8, wherein said remote control comprises a remote power supply being positioned in said remote control, said remote power supply being electrically coupled to said transmitter, said remote power supply comprising at least one battery.

10. The assembly according to claim 1, wherein each of said engagements travels toward said center of said housing when said screws are rotated in said closing direction, each of said engagements travelling toward a respective one of said first end and said second end of said housing when said screws are rotated in said opening direction.

11. The assembly according to claim 10, wherein said plurality of engagements includes a set of first engagements and a set of second engagements, each of said first engagements having a respective one of said screws extending therethrough, each of said second engagements having a respective one of said screws extending therethrough, each of said first engagements being coupled to said top edge of said first shutter, each of said second engagements being coupled to said top edge of said second shutter, each of said first shutter and said second shutter being urged into said open position when said screws are rotated in said opening direction, each of said first shutter and said second shutter being urged into said closed position when said screws are rotated in said closing direction.

12. An automated window shutter assembly comprising:

a pair of shutters, each of said shutters being movably positioned on an exterior wall of a building, each of said shutters being positionable in an open position having each of said shutters being positioned on opposite sides of a window on the exterior wall of the building, each of said shutters being positionable in a closed position having each of said shutters covering the window, each of said shutters having a top edge, said pair of shutters including a first shutter and a second shutter;

a housing being coupled to the exterior wall of the building, said housing being positioned above the window, said housing having a first end, a second end and a lower side extending therebetween, said lower side being open into an interior of said housing, said housing being elongated between said first end and said second end, said housing being horizontally oriented having said lower side being positioned above the window, each of said shutters extending into said lower side of said housing having said top edge of each of said shutters being positioned in said housing while in both the open position and the closed position;

a pair of screws, each of said screws being rotatably positioned within said housing, each of said screws extending from a respective one of said first end and said second end toward a center of said housing, each of said screws having a primary end and a secondary end, said primary end of each of said screws being directed toward the center of said housing, each of said screws being rotatable in a closing direction or an opening direction;

a drive unit being positioned within said housing, said drive unit engaging each of said screws, said drive unit being turned on to rotate each of said screws in a first direction or a second direction, said drive unit comprising:

a gear box having a input and a pair of outputs, said gear box being positioned within said housing, said primary end of each of said screws being coupled to a respective one of said outputs, said input being in mechanical communication with each of said outputs such that said input rotates each of said outputs when said input is rotated, said input having a rotational axis being oriented perpendicular to a rotational axis of each of said outputs;

a motor being coupled to said gear box, said motor engaging said input, said motor being turned on to rotate in a first direction or a second direction, said motor rotating said input in said first direction when said motor is turned on to rotate in said first direction thereby rotating each of said screws in said opening direction, said motor rotating said input in said second direction when said motor is turned on to rotate in said second direction thereby rotating each of said screws in said closing direction, said motor being electrically coupled to a power source comprising an electrical system of the building;

a receiver being positioned in said housing, said receiver being electrically coupled to said motor, said receiver being electrically coupled to the power source comprising the electrical system of the building;

a plurality of engagements, each of said engagements comprising a tube directly threadably engaging a respective one of said screws whereby movement of said respective one of said screws moves said engagement, each of said engagements traveling toward said center of said housing when said screws are rotated in said closing direction, each of said engagements travelling toward a respective one of said first end and said second end of said housing when said screws are rotated in said opening direction, said plurality of engagements including a set of first engagements and a set of second engagements, each of said first engagements having a respective one of said screws extending therethrough, each of said second engagements having a respective one of said screws extending therethrough, each of said first engagements being coupled to said top edge of said first shutter, each of said second engagements being coupled to said top edge of said second shutter, each of said first shutter and said second shutter being urged into said open position when said screws are rotated in said opening direction, each of said first shutter and said second shutter being urged into said closed position when said screws are rotated in said closing direction; and a remote control being in wireless communication with said motor, said remote control turning said motor on in either of said first direction or said second direction for opening or closing said shutters, said remote control comprising:

a transmitter being positioned within said remote control, said transmitter being in wireless communication with said receiver, said transmitter broadcasting an open command or a close command to said receiver;

an open button being movably coupled to said remote control, said open button being electrically coupled to said transmitter, said transmitter broadcasting said open command when said open button is depressed for urging each of said shutters into said open position;

a close button being movably coupled to said remote control, said close button being electrically coupled to said transmitter, said transmitter broadcasting said close command when said close button is depressed for urging each of said shutters into said closed position; and a remote power supply being positioned in said remote control, said remote power supply being electrically coupled to said transmitter, said remote power supply comprising at least one battery.

* * * * *